US007172517B1

(12) United States Patent
Phelps et al.

(10) Patent No.: US 7,172,517 B1
(45) Date of Patent: Feb. 6, 2007

(54) NOVELTY GOLF CLUB

(76) Inventors: Susan Candace Phelps, 7728 E. Moure Dr., Scottsdale, AZ (US) 85262; Christopher Lee Wehrle, 160 Poplar St., Unit H, Denver, CO (US) 90220

( * ) Notice: Subject to any disclaimer, the term of this patent is extended or adjusted under 35 U.S.C. 154(b) by 0 days.

(21) Appl. No.: 11/242,712

(22) Filed: Oct. 3, 2005

Related U.S. Application Data

(60) Provisional application No. 60/616,128, filed on Oct. 4, 2004.

(51) Int. Cl.
*A63B 53/14* (2006.01)

(52) U.S. Cl. ..... 473/316; 40/409

(58) Field of Classification Search ..... 473/316–323; 362/101–102, 109, 806; 40/361, 367, 411–412, 40/415, 439, 477, 915, 409
See application file for complete search history.

(56) References Cited

U.S. PATENT DOCUMENTS 1,894,841 A * 1/1933 Adams ..... 473/326
3,993,314 A * 11/1976 Harrington et al. ..... 473/326
4,541,631 A * 9/1985 Sasse ..... 473/297
4,840,371 A 6/1989 Harris
5,316,300 A * 5/1994 Simmons ..... 473/318
5,452,889 A * 9/1995 Lewinski et al. ..... 473/519
5,527,038 A * 6/1996 Mabie ..... 473/232
5,868,633 A 2/1999 Keheley
6,009,653 A * 1/2000 Harrington ..... 40/660
6,718,675 B1 * 4/2004 Lu ..... 40/661.12

* cited by examiner

*Primary Examiner*—Stephen Blau
(74) *Attorney, Agent, or Firm*—Gregory J. Nelson

(57) ABSTRACT

A novelty golf club, such as a putter, having a head and a shaft. The upper end of the shaft has a hollow, tubular grip section below which is a transparent tubular viewing section. Graphics are displayed on the viewing section. The upper section of the shaft is filled with a fluid. A sleeve is reciprocal within the fluid and has a specific gravity less than the fluid so that when the club is inverted the sleeve is located behind the graphics to obscure viewing of the graphics. When the club is inverted to a playing position, the sleeve, due to its buoyancy, will "float" to a position within the grip to allow viewing of the graphics.

7 Claims, 1 Drawing Sheet

NOVELTY GOLF CLUB

CROSS REFERENCE TO RELATED APPLICATION IS MADE

This application is based on U.S. Provisional Patent Application Ser. No. 60/616,128, filed Oct. 4, 2004, of the same title.

FIELD OF THE INVENTION

The present application relates to a novelty golf club and more particularly relates to a golf club, such as a putter, which in one position displays graphics and when inverted to another position obscures the graphics.

BACKGROUND OF THE INVENTION

Golf is a very popular game and, as a result of this popularity, many specialized golf clubs have been developed over the years. Some of these clubs are simple novelty clubs for the amusement of golfers. Other such clubs may be used for training and for course play if they meet the requirements of the U.S.G.A.

For example, U.S. Pat. No. 4,840,371 shows a novelty golf club having a head, shaft and grip. The head is hollow and contains a sound-producing device powered by batteries. The sound-producing device may be activated by a switch conveniently located on the golf head and may contain a miniature record disk recorded having sounds such as laughter, the sound of a barking dog, fire engines, coughing and other sounds.

U.S. Pat. No. 5,868,633 discloses a novelty club also having a sound chip in communication with a speaker for emitting any one of a plurality of humorous phrases. A plurality of light-emitting diodes are received within the transparent shaft so that the lights are randomly illuminated. The light-emitting diodes and voice chip are activated with an impact switch so that when a user swings the club and impacts an object, the lights automatically illuminate in random pattern and the sound chip emits any one of a plurality of humorous recordings.

Other novelty golf clubs may be of unusual or whimsical shape so as to induce laughter from the participants in a golf game.

Notwithstanding the existence of such clubs, there nevertheless exists a need for a golf club, such as a putter, which will selectively reveal graphics when placed in a normal address or playing position.

BRIEF SUMMARY OF THE INVENTION

Briefly, the present invention relates to a novelty golf club having a graphic display which is not visible when the club is in one position such as when stored in a golf bag with the grip downwardly disposed. When the club is removed from the stored position in the golf bag and placed in a normal use or address position, a sleeve within the upper shaft is displaced by gravity to a position in which viewing of the graphics is no longer obscured and the graphics that are revealed become clearly visible.

The golf club of the present invention may simply be a novelty club or may be used as a playing club, such as a putter. The club has a club head with a shaft having upper and lower sections. The upper section of the shaft is tubular and contains a light, transparent fluid, preferably a light, transparent mineral oil. The upper, distal end of the upper shaft section defines a grip area. The upper shaft section immediately below the grip is transparent and defines a viewing area. Suitable graphics are applied to the tubular viewing area portion, either on the interior or the exterior of the tubular portion. A buoyant sleeve is received within the upper shaft section and preferably has a dark, opaque surface. The sleeve, having a specific gravity less than that of the fluid, under the influence of gravity, will alternatively move to a position behind the graphics obscuring the graphics when the club is in one position and when the club is inverted the sleeve will "float" to a position within the grip area of the upper shaft. When the club is in the normal, use position, the sleeve is positioned behind the grip and the graphics are revealed and are visible. The shaft viewing section below the grip admits light due to the transparency of the tubular material and the fluid. In this position, the graphics become clearly viewable.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 1:
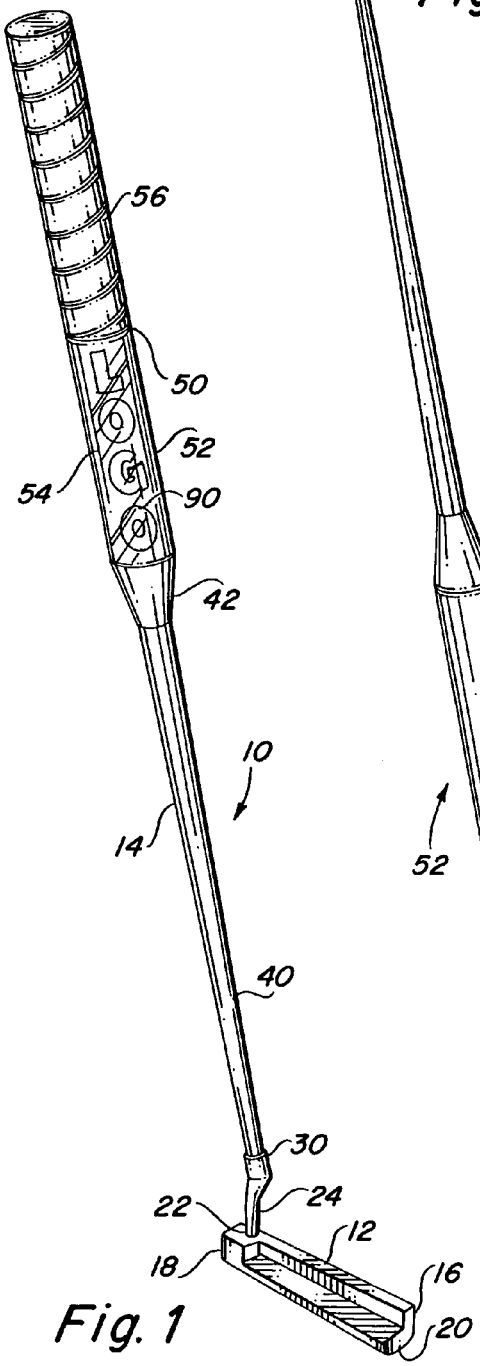
FIG. 1 is a perspective view of the novelty golf club according to the present invention shown in a normal, use position in which the graphics are clearly visible.

Referring to the drawings, the golf club of the present invention is generally designated by the numeral 10 and includes a golf club head 12 attached to a shaft 14 and a hosel 24.

The head 12 may be any shape, it being customary that golf club heads, particularly putters, are provided in a wide range of shapes. The shape shown is representative and has a striking face 16, a heel 18 and a toe 20. A bore 22 in the heel area receives a hosel 24 which is shown as being offset. The material of the head may be wood, metal or a combination of such materials as is customary. The hosel may be joined to the head by a suitable adhesive such as epoxy.

The upper end of the hosel is bored at 30 and receives the lower end of shaft 14. Shaft 14 has a lower section 40 and an upper section 50. Lower section 40 has its lower end received in the bore 30 in the hosel 24 and at the upper end transitions or tapers at 42 to the upper shaft section 50. Lower shaft section 40 may be any suitable material such as steel, wood or a composite material such as graphite.

The upper shaft section 50 comprises a hollow, tubular section 52 which is transparent or translucent so that a viewing area 54 is provided between the tapered transition section 42 and the lower edge of grip 56 at the upper, distal end of the upper shaft section 50. Preferably the tubular section 52 is a rigid, durable material such as a clear acrylic material. The grip 56 may consist of a wrapping or sleeve of conventional golf club gripping material such as rubber or leather. The grip 56 generally extends an axial length of approximately 8" to 12". The length of the viewing section may vary, but is typically about 8" to 10". The axial length of the lower shaft section 14 may also vary but will be approximately 10" to 16".

The tubular section 52 defines a chamber 60 which extends generally from the upper end of the taper 42 to the upper end of the grip 56. This chamber, designated by the numeral 60, is filled with a light-transparent liquid such as a light mineral oil of the type sold under the designation Dynolube®. A cylindrical sleeve 80 is reciprocal within the chamber. The sleeve 80 preferably has an outer opaque dark surface 82 which is matched to approximate the color of the grip, generally black or a dark brown. The sleeve may be a cylindrical plastic material and has a specific gravity which is less than that of the liquid in chamber 60 so that the sleeve, due to its inherent buoyancy, will rise or ascend within the chamber. Thus, when the golf club is in the normal, use position as shown in FIG. 1, the sleeve will ascend within the chamber 60 to a position behind the grip area 56 of the upper shaft. In this position, the sleeve having an axial length approximately the same as the length of the viewing area 52, will be in a non-obscuring position. Accordingly, light may pass through the transparent section 52 and the transparent oil in chamber 60 to provide viewability of graphics 90 on the window. The graphics 90 may be on the exterior portion of the section 52, the interior of the section 52 may be incorporated into the material of the window. The graphics 90 may consist of a logo, an advertising message or a more whimsical graphic feature such as the torso of a male or female body.

Figure 2:
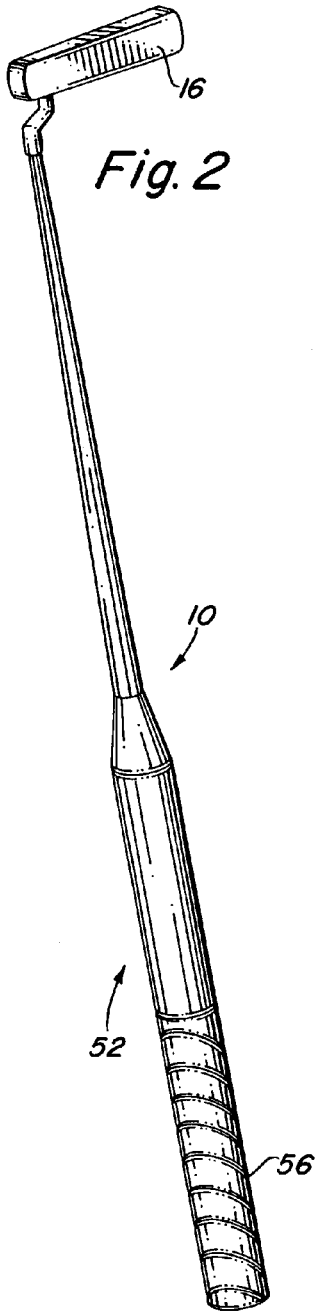
FIG. 2 is a perspective view of the novelty golf club of the present invention shown in an inverted position in which position the sleeve has moved to a position behind the graphics obscuring viewability of the graphics.
Figure 3:
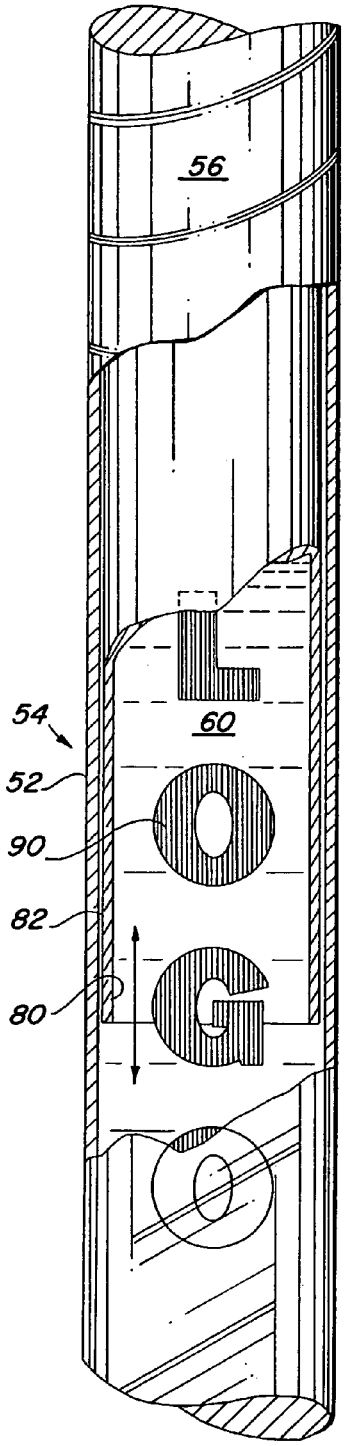
FIG. 3 is a longitudinal view partly broken away and partly in cross-section illustrating the details of the upper shaft section and the sliding sleeve.

When the golf club is inverted to the position shown in FIG. 2, which is the normal position which the golf club would assume when placed in a golf bag, the sleeve 80 will ascend to a position in shaft section 52. In this position, the sleeve 80, being opaque, will block passage of light through the shaft section 52 so that the graphic elements 90 are obscured and are not readily viewable.

By reason of the ability of the sleeve 80 to ascend within the liquid filled chamber 60 due to relative specific gravities of the sleeve and fluid, the graphic element 90 can be displayed by simply inverting the golf club from the position shown in FIG. 2 to the position shown in FIG. 1. Thus, a golfer wishing to demonstrate, and perhaps amuse his or her fellow participants, will remove the golf club from the golf bag. In the bag, the club is positioned with the golf club head disposed upwardly as shown in FIG. 2. The golfer will then proceed to a putting location at which time the golfer will address the ball by placing the club in the use position in FIG. 1. The reversal of the golf club will cause the sleeve 80 to move from its shielding or obscuring position behind section 52 to a position in the upper grip 56 of the shaft in which position section 52 is no longer shielded or obscured from passage of light. This movement of the sleeve will expose the graphics 90 to viewing and, depending upon the nature of graphic element, may both surprise and amuse the participants.

While the present invention has been described with respect to a putter, it will be apparent that any variations of form and appearance of the invention may be made. The putter may be a novelty item or may be a regulation club conforming to USGA standards. For example, the invention may be made to adapt or may be applied to achieve various ornamental or novelty affects. The invention may be applied to not only golf putters, but golf clubs and other sporting items such as baseball bats, pool cues and walking sticks. The novelty items may be used both by sports participants as well as fans wishing to show support for a particular team. In the case of a team support item, the graphic display may be a team name, emblem or logo such as a corporate logo.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. A novelty golf club comprising:

(a) a club head (b) a shaft having a lower end attached to the club head and an upper end with an upper end section, a portion of said upper end section defining a chamber containing fluid;

(c) a portion of said upper end section adjacent the upper end having a grip;

(d) a portion of said upper end section disposed below the grip defining a transparent viewing area;

(e) a graphic element in said viewing area; and (f) a sleeve in said chamber having a specific gravity less than that of the fluid whereby said sleeve will move to a first position within the grip with the club in a first position and will move to a second position in the viewing area obscuring the graphics when the club is in a second inverted position.

2. The novelty golf club of claim 1 wherein the golf club is a putter.

3. The novelty golf club of claim 1 wherein the upper end section is a clear plastic tube.

4. The novelty golf club of claim 1 wherein the sleeve is a dark opaque having a color approximately the color of the grip.

5. The novelty golf club of claim 1 wherein the graphics comprise a human figure.

6. The novelty golf club of claim 1 wherein the graphic element comprises an emblem.

7. The novelty golf club of claim 1 wherein the upper end section is tubular having a diameter greater than said lower end.

* * * * *